United States Patent [19]

Okada et al.

[11] Patent Number: 4,795,493

[45] **Date of Patent: * Jan. 3, 1989**

[54] SOLVENT FOR CHROMOGENIC DYE-PRECURSOR MATERIAL FOR PRESSURE-SENSITIVE RECORDING PAPER SHEET AND PRESSURE-SENSITIVE RECORDING PAPER SHEET PREPARED BY USING THE SOLVENT

[75] Inventors: Yoshio Okada, Matsudo; Tadashi Nakamura; Youichi Ohhira, both of Iwaki, all of Japan

[73] Assignee: Kureha Kagaku Kogyo Kabushiki Kaisha, Tokyo, Japan

[ * ] Notice: The portion of the term of this patent subsequent to Oct. 13, 2004 has been disclaimed.

[21] Appl. No.: 29,927

[22] Filed: Mar. 26, 1987

[30] Foreign Application Priority Data

Feb. 19, 1987 [JP] Japan ..... 62-36686

[51] Int. Cl.[4] ..... C08K 5/01

[52] U.S. Cl. ..... 106/311; 106/21; 106/32; 252/364; 503/213

[58] Field of Search ..... 106/21, 32, 311; 252/364; 503/213

[56] References Cited

U.S. PATENT DOCUMENTS

| | | | |
|---|---|---|---|
| 3,627,581 | 12/1977 | Phillips | 117/36.2 |
| 4,130,299 | 12/1978 | Wygant | 427/145 |
| 4,536,220 | 8/1985 | Kondo et al. | 106/21 |
| 4,684,574 | 8/1987 | Pietsch et al. | 106/21 |
| 4,699,658 | 10/1987 | Okada et al. | 106/21 |
| 4,699,659 | 10/1987 | Okada et al. | 106/21 |

FOREIGN PATENT DOCUMENTS

| | | |
|---|---|---|
| 0056177 | 7/1982 | European Pat. Off. . |
| 50-14570 | 5/1975 | Japan . |
| 56-156222 | 12/1981 | Japan . |
| 1352597 | 5/1974 | United Kingdom . |
| 1462980 | 1/1977 | United Kingdom . |
| 1516383 | 7/1978 | United Kingdom . |
| A2106529 | 4/1983 | United Kingdom . |

OTHER PUBLICATIONS

I.E.C. Product Research and Development, vol. 8, No. 3, pp. 237–241 (1969).

*Primary Examiner*—Amelia Burgess Yarbrough
*Attorney, Agent, or Firm*—Nixon & Vanderhye

[57] ABSTRACT

Disclosed herein are a substantially odorless solvent for a chromogenic dye-precursor material for a pressure-sensitive recording paper sheet, which comprises from 0 to 20% by weight of m-isopropylbiphenyl, from 40 to 75% by weight of p-isopropylbiphenyl and from 5 to 40% by weight of diisopropyldiphenyl, and a pressure-sensitive recording paper sheet comprising a colour-development sheet coated with microcapsules containing a dye solution which is composed of the chromogenic dye-precursor material and the substantially odorless solvent, and a colour-developer sheet.

4 Claims, 1 Drawing Sheet

SOLVENT FOR CHROMOGENIC DYE-PRECURSOR MATERIAL FOR PRESSURE-SENSITIVE RECORDING PAPER SHEET AND PRESSURE-SENSITIVE RECORDING PAPER SHEET PREPARED BY USING THE SOLVENT

BACKGROUND OF THE INVENTION

The present invention relates to a substantially odorless solvent for the chromogenic dye-precursor material for a pressure-sensitive recording paper sheet and a pressure-sensitive recording paper sheet prepared by using the solvent. More in detail, the present invention relates to a solvent for the chromogenic dye-precursor material for the pressure-sensitive recording paper sheet, which comprises from 0 to 20% by weight of m-isopropylbiphenyl, from 40 to 75% by weight of p-isopropylbiphenyl and from 5 to 40% by weight of diisopropylbiphenyl, and a pressure-sensitive recording paper sheet comprising a colour-development sheet coated with microcapsules containing a dye solution which is composed of the chromogenic dye-precursor material and the substantially odorless solvent, and a colour-developer sheet.

A pressure-sensitive recording sheet comprises a colour-development sheet prepared by coating microcapsules, in which a solution of a colourless electron-donating chromogenic dye-precursor material having a colouring reactivity has been encapsulated, onto a supporting sheet and a colour-developer sheet prepared by coating a colour-developer which develops a colour on contacting to the chromogenic dye-precursor material onto the supporting sheet.

In recent years, the pressure-sensitive recording paper sheets have been broadly used instead of carbon copying paper sheets and back-carbon copying paper sheets of pigment type.

As the pressure-sensitive recording paper sheets, it is necessary that they are excellent in colour-development, stability for long term preservation and light resistance and that they are low in toxicity not to cause environmental pollution.

As the solvent which dissolves the chromogenic dye-precursor material for the pressure-sensitive recording paper sheet, it is demanded that the solvent fulfills the following requirements.

(1) To dissolve the chromogenic dye-precursor material to a high concentration.

(2) Not to cause the decomposition and colour-development of the chromogenic dye-precursor material.

(3) To show a considerably high boiling point, and not to evaporate in the thermal drying step and under a high atmospheric temperature.

(4) Not to be educed to water on encapsulating.

(5) To show a high speed of colour-development and a high concentration of the developed colour as well as the high colour stability after colour-developing.

(6) To be stable to light, heat and chemicals.

(7) To show a low viscosity so that its flow out from the broken capsules is freely carried out.

(8) To be substantially odorless.

(9) To show a low toxicity to human body and to be safe.

(10) To show a favorable biodegradability and not to cause environmental pollution.

As the pressure-sensitive recording paper sheet prepared by using the solvent for the chromogenic dye-precursor material, which fulfills the above-mentioned requirements, the following examples have been proposed.

A pressure-sensitive recording paper sheet prepared by using a solvent comprising at least one of alkylated biphenyls or alkylated terphenyls having alkyl group(s) of from 1 to 12 carbon atoms or the mixture with another solvent, wherein the number of the alkyl groups in the alkylated biphenyl is from 1 to 4 and the number of the alkyl groups in the alkylated terphenyl is from 1 to 6, with the proviso that not less than two alkyl groups are the same or different from each other [refer to Japanese Patent Publication No. 49-21608 (1974)].

A material for a recording paper sheet coated with microcapsules encapsulating a solution of a chromogenic dye-precursor material in a solvent comprising not less than 65% by weight of isopropylbiphenyl represented by the formula:

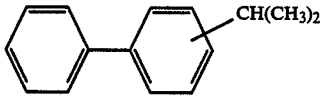

not more than 25% by weight of polyisopropylbiphenyl and not more than 10% by weight of biphenyl [refer to Japanese Patent Publication No. 54-37528 (1979)].

Further, as the method for producing an alkylbiphenyl, a method for producing an alkylbiphenyl rich in m- and p-substituted substances has been known, wherein from 0.5 to 5 mol of a lower olefin is brought into contact with 1 mol of biphenyl at a temperature of not less than 180° C. in the presence of from 0.5 to 10% by weight of a silica-alumina catalyst, a zeolite catalyst or a mixture thereof [refer to Japanese Patent Application Laid-Open No. 56-156222 (1981)].

Particularly, isopropylbiphenyl which is the main component constituting the solvent for the chromogenic dye-precursor for the pressure-sensitive recording paper sheet disclosed in the Japanese Patent Publication No. 54-37528 (1979) is an isomeric mixture of the compound represented by the following structural formula:

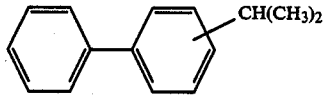

wherein the isopropyl group is bonded to the benzene ring at the position of ortho, meta or para thereof.

Further, in Japanese Patent Publication No. 54-37528 (1979), it has been shown that the suitable composition of the solvent for the chromogenic dye-precursor material for a pressure-sensitive recording paper sheet comprises about 50% by weight of m-isopropylbiphenyl, 30% by weight of p-isopropylbiphenyl, 25% by weight of polyisopropylbiphenyl and 0.5% by weight of biphenyl.

Still more, the commerciallized "isopropylbiphenyl" and the isopropylbiphenyl synthesized by Friedel-Crafts alkylation of biphenyl (refer to Industrial and Engineering Chemistry Product Research and Development Vol. 8, 239–241, 1969) is a mixture of m-isomer and p-isomer (the weight ratio of m-isomer to p-isomer is about 2:1) and contains a little amount of o-isomer.

With the propagation of the pressure-sensitive recording paper sheets, the case where the pressure-sensitive recording paper sheets are used in cold districts of not more than 0° C. in the ambient temperature or transported and preserved for a long time in the environment of about from 40° to 50° C. in the ambient temperature and of not less than about 80% in the relative humidity has increased.

Particularly, in the outdoor facilities such as gasoline service stands, the pressure-sensitive recording paper sheets are used under the environment of not more than 0° C. in winter.

Since in such an environment of low atmospheric temperatures, (1) the solvent for the chromogenic dye-precursor material used in the pressure-sensitive recording paper sheet crystallizes, (2) it takes a very long time for obtaining clear development of colour or (3) the colour-developed image is very light in colour, if developed, not to be deciphered, such a pressure-sensitive recording paper sheet is not to be put to practical use. Namely, it is demanded that an initial colour developing activity within about 30 sec from the recording is at least 40%.

Furthermore, from the viewpoint of the production and preservation of the pressure-sensitive recording paper sheet, an offer of a substantially odorless solvent for the chromogenic dye-precursor material for the pressure-sensitive recording paper sheet has been earnestly desired. The problem of offensive odor occurs in the process for preparing the pressure-sensitive recording paper sheet when the recording paper sheet material prepared by applying the microcapsules containing the solution of the chromogenic dye-precursor material onto the supporting paper sheet is cut after drying thereof. Namely, when the pressure-sensitive recording paper sheet is cut at a relatively high temperature of from 40° to 50° C., the solvent flowing out from the thus broken microcapsules gives a disagreeable impression to the operators. In addition, in the cases when the solvent adheres to clothes or hands of the operator in the cutting step of the pressure-sensitive recording paper sheet or in handling of the solvent, the odor still remains even after washing the clothes or the hands with a cleanser to give a disagreeable impression. Furthermore, the pressure-sensitive recording paper sheets which have been subjected to recording are assembled and preserved in a storehouse for a relatively long time. In such an occasion, the odor emitted from a large amount of the pressure-sensitive recording paper sheets which have been subjected to recording becomes the cause of disagreeable impression.

On examining the above-mentioned problem of odor of the pressure-sensitive recording paper sheet, the isopropylbiphenyl which has been hitherto proposed as the solvent for the chromogenic dye-precursor material for the pressure-sensitive recording paper sheet is not favorable as the solvent for such a purpose. Namely, the isopropylbiphenyl is an isomeric mixture of o-isopropylbiphenyl, m-isopropylbiphenyl and p-isopropylbiphenyl or an isomeric mixture of m-isopropylbiphenyl as the main component and p-isopropylbiphenyl. Ortho-isopropylbiphenyl shows a disagreeable odor, and also m-isopropylbiphenyl has an odor. On the other hand, although p-isopropylbiphenyl is almost odorless and excellent in the property of dissolving the chromogenic dye-precursor material, since the melting point of p-isopropylbiphenyl is relatively high, it has a defect that crystals thereof are apt to be educed at a low temperature.

Accordingly, it has been desired to provide with a solvent for the chromogenic dye-precursor material for the pressure-sensitive recording paper sheet, which is almost odorless, from which crystals thereof are scarcely educed at a low temperature (for instance, 0° C.) and which shows an excellent initial colour-developing property.

As a result of the present inventors' studies for providing with a solvent for the chromogenic dye-precursor material for a pressure-sensitive recording paper sheet, which has the specific character required as above, it has been found out by the present inventors that a solvent comprising from 0 to 20% by weight of m-isopropylbiphenyl, from 40 to 75% by weight of p-isopropylbiphenyl and from 5 to 40% by weight of diisopropylbiphenyl is almost odorless, that the crystals of such a solvent are scarcely educed at a low temperature and that such a solvent fulfills all the conditions to be possessed by the solvent for the chromogenic dye-precursor material for a pressure-sensitive recording paper sheet, and on the basis of the findings, the present inventors have effected the present invention.

SUMMARY OF THE INVENTION

In a first aspect of the present invention, there is provided a substantially odorless solvent for the chromogenic dye-precursor material for a pressure-sensitive recording paper sheet, which comprises from 0 to 20% by weight of m-isopropylbiphenyl, from 40 to 75% by weight of p-isopropylbiphenyl and from 5 to 40% by weight of diisopropylbiphenyl.

In a second aspect of the present invention, there is provided a pressure-sensitive recording paper sheet comprising a colour-development sheet coated with microcapsules containing a dye solution which is composed of a colourless chromogenic dye-precursor material and a substantially odorless solvent comprising from 0 to 20% by weight of m-isopropylbiphenyl, from 40 to 75% by weight of p-isopropylbiphenyl and from 5 to 40% by weight of diisopropylbiphenyl, and a colour-developer sheet.

BRIEF EXPLANATION OF DRAWING

Of the attached drawing.

DETAILED DESCRIPTION OF THE INVENTION

Figure 1:
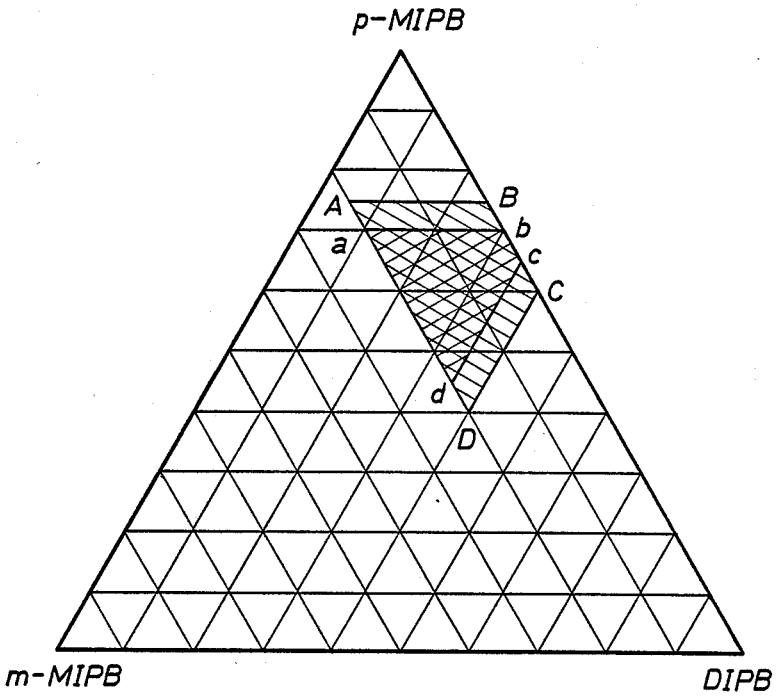
FIG. 1 is a triangle showing the composition of the solvent according to the present invention, which contains m-MIPB, p-MIPB and DIPB.

The solvent of the present invention is a mixed solvent comprising from 0 to 20% by weight of m-isopropylbiphenyl (hereinafter referred to as m-MIPB), from 40 to 75% by weight of p-isopropylbiphenyl (hereinafter referred to as p-MIPB) and from 5 to 40% by weight of diisopropylbiphenyl (hereinafter referred to as DIPB).

The mixing rates of m-MIPB, p-MIPB and DIPB which are the components constituting the solvent for the chromogenic dye-precursor material for the pressure-sensitive recording paper sheet according to the present invention are in the range shown by the points A, B, C and D in the triangle shown in FIG. 1.

The composition of the point A in FIG. 1 is 20% by weight of m-MIPB, 75% by weight of p-MIPB and 5% by weight of DIPB, composition of the point B is 0% by weight of m-MIPB, 75% by weight of p-MIPB and 25% by weight of DIPB, the composition of the point C is 0% by weight of m-MIPB, 60% by weight of p-MIPB and 40% by weight of DIPB and the composition of the point D is 20% by weight of m-MIPB, 40% by weight of p-MIPB and 40% by weight of DIPB.

The mixed solvent within the above-mentioned range is almost odorless, crystals thereof are scarcely educed therefrom at a low temperature, for instance, 0° C. and the colour-developing property is excellent. Namely, the rate of initial colour-development after 30 sec of recording at −5° C. is larger than the practical value (40%) and accordingly, the mixed solvent according to the present invention is useful as the solvent for the chromogenic dye-precursor material for the pressure-sensitive recording paper sheet.

The preferable mixing rate of the solvent according to the present invention is in the range shown by the points a, b, c and d. The composition of the point a is 20% by weight of m-MIPB, 70% by weight of p-MIPB and 10% by weight of DIPB, the composition of the point b is 0% by weight of m-MIPB, 70% by weight of p-MIPB and 30% by weight of DIPB, the composition of the point c is 0% by weight of m-MIPB, 65% by weight of p-MIPB and 35% by weight of DIPB and the composition of the point d is 20% by weight of m-MIPB, 45% by weight of p-MIPB and 35% by weight of DIPB.

In the case where the content of m-MIPB in the mixed solvent is more than 20% by weight, since the problem of odor occurs, such a situation is undesirable. In the case where the content of p-MIPB is more than 75% by weight, since the crystals thereof are apt to be educed at a low temperature, such a situation is also undesirable. Furthermore, in the case where the content of DIPB is more than 40% by weight, since the colour-developing property at a low temperature becomes insufficient, such a situation is also undesirable.

Although DIPB which is one of the components constituting the solvent according to the present invention is a mixture of isomers 2,2'-DIPB, 2,3'-DIPB, 2,4'-DIPB, 3,3'-DIPB, 3,4'-DIPB and 4,4'-DIPB, the effect of the present invention is not limited by the kinds of the isomers of DIPB.

So far as the above-mentioned specific properties of the solvent for the chromogenic dye-precursor material for the pressure-sensitive recording paper sheet according to the present invention, namely the substantial odorlessness, the excellent colour-developing property at a low temperature and the property of scarcely educing crystals thereof at a low temperature, are not damaged, any publicly known solvent for the chromogenic dye-precursor material for the pressure-sensitive recording paper sheet, for instance, diisopropylnaphthalene, hydrogenated terphenyl and butylbiphenyl or any publicly known diluent fdr the solvent for the chromogenic dye-precursor material for the pressure-sensitive recording paper sheet, for instance, dodecylbenzene and kerosene can be added to the solvent for the chromogenic dye-precursor material for the pressure-sensitive recording paper sheet according to the present invention.

The solvent according to the present invention can be obtained by mixing m-MIPB, p-MIPB and DIPB at the mixing ratio in the above-mentioned range, and also can be produced according to the following methods.

(1) The method comprises the steps of reacting biphenyl with propylene at a temperature of from 120° to 260° C. in the presence of a silica-alumina catalyst, thereby carrying out the propylation of biphenyl, and subjecting the thus obtained reaction product to distillation, thereby obtaining the fraction having a mean boiling point of from 138° to 149° C. under a reduced pressure of 5 mmHg.

(2) The method comprises the steps of reacting biphenyl with propylene at a temperature of from 50° to 110° C. in the presence of a catalyst of aluminum chloride, thereby carrying out the propylation of biphenyl, subjecting the thus obtained reaction product to distillation under a reduced pressure, thereby rectifying p-MIPB, and mixing the thus rectified p-MIPB with DIPB which has been separately rectified, at a predetermined ratio.

As the catalyst used in the method of propylation of biphenyl, the silica-alumina catalyst which, in the reaction of transalkylation of a mixture of naphthalene and diisopropylnaphthalene at 280° C., (i) shows the initial activity of not less than 0.1 kg of naphthalene/hour.kg of catalyst, preferably not less than 0.2 kg of naphthalene/hour.kg of catalyst and (ii) retains the activity of not less than 90% even after treating the mixture of naphthalene and dissopropylnaphthalene in an amount of 100 times by weight of the catalyst is desirable.

As the silica-alumina catalyst having the above-mentioned specific properties, the catalysts made by NIKKI Chemical Industries Co., Ltd. under the respective codes of X-632HN and N-632L may be exemplified.

The reaction temperature of propylation is from 120° to 260° C., preferably from 150° to 240° C. In the case where the reaction temperature is less than 120° C., since the reaction velocity is low, such a reaction temperature is not practical, and on the other hand, in the case where the reaction temperature is more than 260° C., since the decompositive reaction occurs as well as the alkylation reaction and the reaction product shows a disagreeable odor, such a temperature is undesirable.

The heart of the present invention is characterized by using microcapsules containing a dye solution which is composed of the chromogenic dye-precursor material and a substantially odorless solvent comprising from 0 to 20% by weight of m-MIPB, from 40 to 75% by weight of p-MIPB and from 5 to 40% by weight of DIPB. Accordingly, all the methods publicly known by the persons skilled in the art can be applied to produce the pressure-sensitive recording paper sheet without being limited to the chromogenic dye-precursor material, the colour-developer, the method of encapsulation, the method for preparing the slurry of the capsules, the method for applying the slurry, etc.

For instance, as the method of encapsulation, the method of the coacervation disclosed in U.S. Pat. Nos. 2,800,457 and 2,800,458, the method of the interfacial polymerization disclosed in British Pat. No. 990,443 and U.S. Pat. No. 3,287,154, and several other methods can be utilized.

As the chromogenic dye-precursor material, triphenylmethanes, diphenylmethanes, xanthenes, thiazines, spiropyranes, etc. may be exemplified. Further as the acidic substance used as the colour-developer, active claysh substance such as Japanese acid clay, active clay, atapalgite, bentonite, zeolite and the like or organoacidic substance such as phenol resin, acid-reactive phenol-formaldehyde novolak resin, organoacidic substance such as metallic salt of an aromatic organic acid, etc. may be exemplified.

The solvent for the chromogenic dye-precursor material for the pressure-sensitive recording paper sheet according to the present invention is almost odorless and excellent in solubility of the chromogenic dye-precursor material, and fulfills the above-mentioned necessary conditions to be possessed by the solvent for the dye-precursor material for the pressure-sensitive recording paper sheet, and scarcely educes crystals of the solvent at a low temperature (0° C.).

Furthermore, the initial colour-development of the pressure-sensitive recording paper sheet after 30 sec of recording at a low temperature of −5° C. is not less than 40% and accordingly, the pressure-sensitive recording paper sheet of the present invention can be sufficiently put to practical use.

The present invention will be concretely explained while referring to the following non-limitative examples.

Method for measuring the catalytic activity

Apparatus:

In the lower part of a stainless-steel reaction tube of an inner diameter of about 25 mm, 10 ml of glass beads of 2 mm in diameter are filled up for supporting the catalyst, and 25 ml of the catalyst are filled up on the thus filled glass beads.

Furthermore, 20 ml of glass beads of 2 mm in diameter are filled up, as the preheating zone, on the layer of the catalyst.

Heating of the thus filled materials is conducted from outside by an electric heater, and the inner temperature of the tube is measured by a thermocouple inserted in the reaction tube.

Method:

By heating an equimolar mixture of naphthalene and dissopropylnaphthalene (an isomeric mixture) to about 60° C., naphthalene is dissolved in diisopropylnaphthalene. From the upper part of the reaction tube, the thus prepared mixture is supplied at a definite flow rate to react continuously naphthalene with diisopropylnaphthalene while maintaining the temperature of the catalyst layer at 280° C. The reaction liquid which flows out from the lower part of the reaction tube is cooled to a temperature of lower than 100° C., and is put to sampling on occasion to be analyzed by gaschromatography. The flow rate of the reaction liquid from the reaction tube is set up so that the initial conversion rate of naphthalene is from 10 to 20%. As the raw materials of the reaction, naphthalene and diisopropylnaphthalene containing scarcely the components such as sulfur, nitrogen compounds, etc., which deteriorate the catalytic activity, are used.

Evaluation of the catalytic activity:

From the analytical results of the product obtained during the period from the commencement of the reaction to the time when the mixture of naphthalene and diisopropylnaphthalene in amount of about 5 times by weight of the catalyst has been reacted, the conversion of naphthalene ($X_0$) is obtained, and the initial activity of the catalyst is obtained according to the following formula:

$$\text{Initial activity } (A_0) = \frac{(W_N) \times (X_0)}{(W_C)}$$

wherein $W_C$ is the amount of the thus filled catalyst and $W_N$ is the supplying speed of naphthalene (g/hour).

The reaction is continuously carried out, and at the time when the mixture of naphthalene and diisopropylnaphthalene has been reacted in an amount of 100 times of the weight of the catalyst, the conversion of naphthalene ($X_{100}$) is obtained from the analytical results of the product, and the retaining rate of the catalytic activity ($A_p$) is obtained according to the following formula:

$$\text{Retaining rate of catalytic activity } (A_p) = \frac{(X_{100})}{(X_0)} \times 100.$$

TEST EXAMPLE OF CATALYTIC ACTIVITY

In a reaction tube, 25 g of a silica-alumina catalyst (pellets of 3 mm in diameter, made of NIKKI Chemical Industries Co., Ltd., Model: X-632HN) was filled up, and an equimolar mixture of naphthalene and diisopropylnaphthalene was supplied at the rate of 250 ml/hour (245 g/hour) to carry out transalkylation reaction.

After 30 min and 10 hours of the commencement of the reaction, the reaction liquid was sampled and analyzed by gaschromatography, the results being as follows:

$X_0$=17.0%, $X_{100}$=16.2% and $A_p$=95.3%.

Furthermore, since $W_N$ is 92.2 g/hour and $W_C$ is 25 g, the initial catalytic activity was obtained as follows:

$$A_0 = \frac{92.2 \times 0.17}{25} = 0.63 \text{ kg/hour} \cdot \text{kg-catalyst.}$$

EXAMPLE 1

Into a stainless-steel autoclave of a capacity of 1.5 liters, 1000 g of biphenyl and 100 g of the catalyst used in Test Example of Catalytic Activity were introduced, and the content was heated to a temperature of not less than 70° C. to melt biphenyl. The agitation was started and the content of the autoclave was further heated to bring the inner temperature of the autoclave to 240° C.

Gaseous propylene was introduced into the autoclave from a propylene gas-bomb to carry out the propylation reaction while maintaining the pressure in the autoclave at about 2 kg/cm$^2$G.

During the reaction, the reaction mixture was sampled on occassion to analyze the composition of the reaction mixture, and at the time when the mean propylation degree became about 1.0, the supply of propylene gas was stopped and the autoclave was cooled to collect the reaction liquid. The composition of the thus collected reaction liquid is shown in Table 1 below.

TABLE 1

| Component | Composition (mol %) |
|---|---|
| Biphenyl | 27.8 |
| o-Isopropylbiphenyl(o-MIPB) | 6.0 |
| m-Isopropylbiphenyl(m-MIPB) | 18.7 |
| p-Isopropylbiphenyl(p-MIPB) | 22.1 |
| Diisopropylbiphenyl(DIPB) | 23.9 |
| Triisopropylbiphenyl(TIPB) and others | 1.5 |

The thus obtained reaction mixture was carefully rectified at 140° C. under a reduced pressure of 5 mmHg, the composition of the thus obtained fraction being shown in Table 2.

TABLE 2

| Component | Composition (% by weight) |
|---|---|
| m-MIPB | 15.0 |
| p-MIPB | 71.9 |
| DIPB | 13.1 |

COMPARATIVE EXAMPLE 1

In the same manner as in Example 1, propylation of biphenyl was carried out, and the thus obtained reaction mixture was fractionally distilled under a reduced pressure of 5 mmHg, thereby collecting the fraction distilled from 141° to 150° C. The composition of the thus obtained fraction is shown in Table 3.

TABLE 3

| Component | Composition (% by weight) |
|---|---|
| m-MIPB | 0.8 |
| p-MIPB | 47.6 |
| DIPB | 51.6 |

EXAMPLES 2 to 4 and COMPARATIVE EXAMPLE 2

By using the same silica-alumina catalyst, propylation of biphenyl was carried out at a temperature shown in Table 4 and in same manner as in Example 1. By subjecting the thus obtained reaction mixture to the same method of distillation as in Example 1, the fraction comprising p-MIPB as the main component was obtained.

The composition of the reaction product and that of the fraction are shown in Table 4.

EXAMPLE 5

Into a glass autoclave of a capacity of 1 litre, 500 g of biphenyl were introduced, and the inner temperature of the autoclave was raised to 80° C. to melt the introduced biphenyl. After adding 14 g of anhydrous aluminum chloride as the catalyst into the molten biphenyl, the autoclave was tightly closed and agitation was started. Propylene gas was introduced into the autoclave from a gas-bomb to carry out the alkylation reaction while maintaining the inner temperature of the autoclave at from 100° to 110° C. and maintaining the inner pressure of the autoclave at about 1 kg/cm$^2$G, and the reaction was continued until the mean alkylation degree became about 1.

After the reaction was over, the reaction mixture was washed with hydrochloric acid and then with water to remove the catalyst from the reaction mixture. The thus obtained reaction mixture was distilled in a rectifying tower of reduced pressure to separate about 120 g of p-MIPB of a purity of 92%.

The thus obtained crude p-MIPB was cooled in a jacketed glass vessel to 12° C. to a slurry-like substance. The slurry-like substance was subjected to centrifugal separation thereby obtaining p-MIPB of a purity of 99%.

On the other hand, 26 g of a mixture of 8% by weight of p-MIPB and 92% by weight of DIPB were separated by the distillation of the reaction mixture.

By combining the thus separated mixture of p-MIPB and DIPB with p-MIPB of a purity of 99%, a mixture of 73.2% by weight of p-MIPB and 26.8% by weight of DIPB was obtained.

COMPARATIVE EXAMPLE 3

In the same manner as in Example 5, propylation of biphenyl was carried out and the thus obtained reaction mixture was carefully distilled under a reduced pressure of 5 mmHg, thereby collecting the fraction distilled from 138° to 149° C. The composition of the reaction mixture and the thus obtained fraction is shown in Table 5.

TABLE 4

| | Example and Comparative Example | | | |
|---|---|---|---|---|
| | Example 2 | Example 3 | Example 4 | Comparative Example 2 |
| Reaction temperature (°C.) | 150 | 200 | 255 | 300 |
| Reaction mixture (mol %) | | | | |
| Biphenyl | 27.8 | 28.4 | 28.5 | 27.5 |
| o-MIPB | 21.3 | 14.3 | 2.4 | 1.8 |
| m-MIPB | 5.8 | 10.0 | 22.9 | 26.5 |
| p-MIPB | 15.7 | 18.3 | 20.8 | 18.2 |
| DIPB | 27.3 | 27.0 | 23.6 | 23.0 |
| TIPB and others | 2.1 | 2.0 | 1.8 | 3.0 |
| Fraction (% by weight) | | | | |
| m-MIPB | 7.5 | 11.6 | 16.2 | 15.8 |
| p-MIPB | 56.3 | 63.6 | 74.7 | 80.3 |
| DIPB | 36.2 | 24.8 | 9.1 | 3.9 |

TABLE 5

| Component | Reaction mixture (mol %) | Fraction (% by weight) |
|---|---|---|
| Biphenyl | 28.6 | — |
| o-MIPB | 0.2 | — |
| m-MIPB | 26.4 | 7.3 |
| p-MIPB | 17.2 | 92.2 |
| DIPB | 24.1 | 0.5 |
| TIPB and others | 3.5 | — |

EXAMPLE 6

(Preparation of the solvent for the chromogenic dye-precursor material for the pressure-sensitive paper sheet)

One hundred milliliters of the solvent obtained in Example 1 were warmed to 150° C., and 30 g of Crystal Violet Lactone (a blue dyestuff made by HODOGAYA Chemical Industries Co., Ltd.) (hereinafter referred to as CVL) were dissolved in the thus warmed solvent under agitation.

The thus prepared solution was introduced into a thermostat at 20° C. and left therein, and the concentration of CVL was measured in course of the time. The results are shown in Table 6. As are clearly seen in Table 6, the state of the extremely high concentration was maintained for a long time period.

TABLE 6

| | Time passed (day) | | |
|---|---|---|---|
| | 1 | 7 | 14 |
| Concentration of CVL in the solution (g/100 ml) | 19.6 | 13.9 | 10.8 |

EXAMPLE 7

Preparation of microcapsules

Microcapsules were prepared by using the solvent for the dye-precursor material for the pressure-sensitive recording paper sheet obtained in Example 6 according to the following method.

Six hundred and thirty grams of melamine and 1620 g of formalin (an aqueous 37% solution of formaldehyde) adjusted to pH of 9.0 by an aqueous 2% solution of sodium hydroxide were mixed, and the thus obtained mixture was heated to 70° C. Just after the dissolution of melamine, 2250 g of water were added to the thus obtained solution and the whole mixture was stirred for 3 min to obtain an aqueous solution of melamine-formaldehyde prepolymer.

Separately, 1460 g of formalin adjusted to pH of 8.5 by triethanolamine and 600 g of urea were mixed together and the thus obtained mixture was reacted for 1 hour at 70° C. to obtain an aqueous solution of urea-formaldehyde prepolymer.

Furthermore, 1620 g of formalin and 600 g of urea were mixed and the thus formed mixture was stirred. To the thus prepared mixture, triethanolamine was added to adjust the pH of the mixture to 8.8 and the thus treated mixture was reacted for 30 min at 70° C. To 400 g of the thus prepared reaction mixture, 24 g of water and 30 g of tetraethylenepentamine were added and the pH of the thus formed mixture was adjusted to 3 by adding an aqueous 15% solution of hydrochloric acid while stirring the mixture at 70° C. Since the pH of the mixture was reduced with the progress of the reaction, the pH was re-adjusted to 3 by the addition of an aqueous 10% solution of sodium hydroxide, and the reaction was continued while lowering the temperature of the reaction mixture to 55° C.

At the time when the viscosity of the reaction mixture became 200 cps, the reaction mixture was neutralized with an aqueous 10% solution of sodium hydroxide and then, 4000 g of water were added to the thus neutralized reaction mixture to obtain an aqueous solution of a water-soluble cationic urea resin.

After adjusting the pH of the liquid mixture of 1000 g of the aqueous solution of melamine-formaldehyde prepolymer, 500 g of the aqueous solution of urea-formaldehyde prepolymer, 1580 g of the aqueous solution of a water-soluble cationic urea resin, 620 g of water and 10 g of triethanolamine to 5.2 by the addition of an aqueous 10% solution of citric acid, 30 g of an aqueous 10% solution of NEOPELEX® (a surfactant made by KAO-ATLAS Co., Ltd.) were added to the liquid mixture to obtain "A" liquid.

Separately, 500 g of CVL were dissolved in 9500 g of the solvent obtained in Example 1 to prepare "B" liquid, and 1000 ml of "B" liquid were emulsified in "A" liquid in a homogenizer so that the diameter of the droplets of "B" liquid becomes from 2 to 8 μm. Thereafter, the thus formed emulsion was kept at 30° C. while gently stirring thereof and the pH of the emulsion was adjusted to 3.6 by the addition of an aqueous 1% solution of citric acid. After further stirring the emulsion for 1 hour, 2000 ml of water were added to the thus treated emulsion. After leaving the emulsion for 3 hours, an aqueous 20% solution of citric acid was added to the emulsion to adjust the pH thereof to 3.0 and the agitation was continued for 20 hours to obtain a slurry of microcapsules.

Preparation of the pressure-sensitive recording paper sheet

To 600 ml of an aqueous 10% solution of polyvinyl alcohol (made by KURARE Co., Ltd.) (hereinafter referred to as PVA), which had been prepared separately, 300 g of the thus obtained microcapsules were added, and by stirring the thus formed mixture well, a liquid dispersion of the microcapsules was obtained.

Onto a paper sheet of 45 g/m$^2$, the liquid dispersion was applied so that the applied amount of the microcapsules was 22 g/m$^2$. By superposing the thus treated paper sheet with a colour-developing paper sheet on which a colour-developing substance having a polycondensate of p-phenylphenol and formaldehyde as the main colour-developer has been applied according to a conventional method, the pressure-sensitive recording paper sheet according to the present invention was obtained.

After subjecting the thus obtained pressure-sensitive recording paper sheet to colour-development by a typewriter made by OLIVETTI Co. under an ordinary environment and preserving the thus treated pressure-sensitive recording paper sheet in a dark place for 24 hours, the concentration of the thus developed colour was measured by a refraction chromaticity meter made by MACBETH Co.

On the other hand, a pressure-sensitive recording paper sheet prepared by the same procedures as above was subjected to colour-development in the same manner as above, however, under an environment of −5° C., and the change of the colour density was measured from just after the colour-development by the same refraction chromaticity meter. Thereafter, the relative rate of colour-development at each time in course of the time from the time of the beginning of colour-development was obtained, in the case where the colour density of the thus-treated pressure-sensitive recording paper sheet after preserving thereof for 24 hours at room temperature was appointed as 100. The results are shown in Table 7. As seen in Table 7, the thus formed pressure-sensitive recording paper sheet showed a sufficient colour-developing ability even at the initial time such as 30 sec after typewriting.

TABLE 7

| | Time passed | | |
|---|---|---|---|
| | 30 sec | 1 min | 1 hour |
| Rate of colour-development | 70% | 77% | 88% |

EXAMPLE 8

By using each of the solvents obtained in Examples 2 to 5 and Comparative Example 1, each of the pressure-sensitive recording paper sheets was prepared according to the method in Example 6.

The initial colour-development of each of the thus obtained pressure-sensitive recording paper sheets (colour-development after 30 sec of the recording at a temperature of −5° C.) is shown in Table 8.

TABLE 8

| | No. of Example | | | | |
|---|---|---|---|---|---|
| | Example 2 | Example 3 | Example 4 | Example 5 | Comparative Example 1 |
| Rate of colour- | 57 | 62 | 72 | 59 | 25 |

TABLE 8-continued

| | No. of Example | | | | |
|---|---|---|---|---|---|
| | Example 2 | Example 3 | Example 4 | Example 5 | Comparative Example 1 |
| development (%) | | | | | |

TEST EXAMPLE 1

On each of the solvents obtained in Examples 1 to 5 and Comparative Examples 2 and 3 the panel test concerning the odor of the solvent was carried out by 20 men and 20 women (total 40 persons) unintentionally selected. The results are shown in Table 9.

TABLE 9

| No. of Example or Comparative Example | Number of evaluating person | | | | Evaluation |
|---|---|---|---|---|---|
| | A | B | C | D | |
| Example 1 | 6 | 26 | 8 | 0 | B |
| Example 2 | 7 | 28 | 5 | 0 | B |
| Example 3 | 7 | 24 | 9 | 0 | B |
| Example 4 | 4 | 25 | 11 | 0 | B |
| Example 5 | 3 | 26 | 10 | 1 | B |
| Comparative Example 3 | 0 | 9 | 13 | 18 | D |

(Note)
Evaluation A: odorless
B: almost odorless
C: odor was present
D: disagreeable odor was present As the solvent for the chromogenic dye-precursor material for the pressure-sensitive reocrding paper sheet which can be put to practical use, it is necessary that the solvent is evaluated to be A or B.

TEST EXAMPLE 2

Each of the solvents obtained in Examples 1 to 5 and Comparative Examples 2 and 3 was kept for 24 hours in a thermostat of 5° C., and in a thermostat of 0° C., and the presence or absence of eduction of crystals from the solvent was observed. The results are shown in Table 10.

TABLE 10

| | No. of Example | | | | | | |
|---|---|---|---|---|---|---|---|
| | Example 1 | Example 2 | Example 3 | Example 4 | Example 5 | Comparative Example 2 | Comparative Example 3 |
| 5° C. | A | A | A | A | A | B | C |
| 0° C. | A | A | A | B | A | C | C |

Notes:
A: no crystal was educed.
B: crystals were scarcely educed.
C: a large amount of crystals was educed.

As the solvent for the chromogenic dye-precursor material for the pressure-resistant recording paper sheet, it is necessary that the result of the evaluation is A or B.

What is claimed is:

1. A solvent for the chromogenic dye-precursor material for a pressure-sensitive recording paper sheet, which comprises from 0 to 20% by weight of m-isopropylbinphenyl, from 40 to 75% by weight of p-isopropylbiphenyl and from 5 to 40% by weight of diisopropylbiphenyl.

2. A substantially odorless solvent for a chromogenic dye-precursor material for a pressure-sensitive recording paper sheet, the solvent consisting essentially of form 0 to 20% by weight of m-isoppropylbiphenyl, from 40 to 75% by weight of p-isopropylbiphenyl, and from 5 to 40% by weight of diisopropylbiphenyl.

3. The solvent of claim 2 in which the components fall within points A, B, C and D of FIG. 1.

4. The solvent of claim 3 in which the components fall within points a, b, c and of FIG. 1.

* * * * *

UNITED STATES PATENT AND TRADEMARK OFFICE

CERTIFICATE OF CORRECTION

PATENT NO. : 4,795,493

DATED : January 3, 1989

INVENTOR(S) : OKADA et al

It is certified that error appears in the above-identified patent and that said Letters Patent is hereby corrected as shown below:

Change "a, b, c and of Fig. 1" on line 2 of claim 4 to --a, b, c and d of Fig. 1--.

Signed and Sealed this

Tenth Day of April, 1990

*Attest:*

HARRY F. MANBECK, JR.

*Attesting Officer*

*Commissioner of Patents and Trademarks*